US012523126B2

(12) United States Patent
Asif et al.

(10) Patent No.: US 12,523,126 B2
(45) Date of Patent: Jan. 13, 2026

(54) REGULATING DETONATION OF PERFORATION MODULES IN UNBALANCED CONDITIONS

(71) Applicant: Saudi Arabian Oil Company, Dhahran (SA)

(72) Inventors: Adnan B. Asif, Udhailiyah (SA); Naresh K. Purusharthy, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 18 days.

(21) Appl. No.: 18/403,417

(22) Filed: Jan. 3, 2024

(65) Prior Publication Data

US 2025/0215769 A1 Jul. 3, 2025

(51) Int. Cl.
*E21B 43/1185* (2006.01)
*E21B 43/116* (2006.01)

(52) U.S. Cl.
CPC ..... *E21B 43/116* (2013.01); *E21B 43/1185* (2013.01)

(58) Field of Classification Search
CPC ..... E21B 43/1185
See application file for complete search history.

(56) References Cited

U.S. PATENT DOCUMENTS

| | | | | |
|---|---|---|---|---|
| 4,306,628 | A | 12/1981 | Adams, Jr. et al. | |
| 4,566,538 | A | 1/1986 | Peterson | |
| 4,566,544 | A | 1/1986 | Bagley et al. | |
| 5,369,579 | A * | 11/1994 | Anderson | F42D 1/04 175/4.54 |
| 6,095,258 | A | 8/2000 | Reese et al. | |
| 10,352,144 | B2 | 7/2019 | Entchev et al. | |
| 2009/0033332 | A1* | 2/2009 | Goodman | E21B 43/1185 367/81 |
| 2017/0175501 | A1* | 6/2017 | van der Ende | E21B 47/12 |
| 2019/0345376 | A1* | 11/2019 | Purdy | E21B 43/26 |

FOREIGN PATENT DOCUMENTS

| | | |
|---|---|---|
| CA | 1201058 | 2/1986 |

OTHER PUBLICATIONS

Stolboushkin et al., "Novel Electro-Hydraulic Intelligent Firing Head for Tubing Conveyed Perforating," Prepared for presentation at the SPE Annual Technical Conference and Exhibition held in New Orleans, Louisiana, USA, Sep. 30, 2013, 13 pages.

* cited by examiner

*Primary Examiner* — Giovanna Wright
(74) *Attorney, Agent, or Firm* — Fish & Richardson P.C.

(57) ABSTRACT

Systems and methods for perforating wellbores include comparing a signal from the least one pressure sensor with a preset pressure and, in response to determining that the signal from the least one pressure sensor is within a preset pressure range, transmitting the activation signal to a firing head.

9 Claims, 5 Drawing Sheets

REGULATING DETONATION OF PERFORATION MODULES IN UNBALANCED CONDITIONS

TECHNICAL FIELD

This specification relates to regulating detonation of perforation modules, particularly in wells in unbalanced conditions.

BACKGROUND

The completion of oil and gas wells typically includes forming perforations (i.e., holes through the casing or liner of the wells) to connect the wellbore to the reservoir. The perforations provide a channel between the pay zone and the wellbore allowing hydrocarbons to flow into the wellbore. In cased hole completions, wells are drilled down past the section of the formation desired for production and the casing or liner are run in separating the formation from the well bore. A perforation tool is then run in to the desired depth and activated to perforate the casing or liner. Perforating methods include bullet guns, abrasive approaches, water jets, and shaped charges.

SUMMARY

This specification describes systems and methods for safely perforating oil and gas wells in under-balanced wellbore conditions using wireline perforation tools (e.g., perforation guns or shaped charges). Non-explosive perforations (abrasion and water jetting) are performed using coiled tubing or jointed pipes. During such operations, the risk of gun jumps does not exist due to BHA deployment on heavy duty, high strength and high pressure coil tubing pipe or jointed pipe. To clarify, the gun jumps happen due to the shock wave that is generated at the very moment the explosives are fired. This approach includes deploying a downhole detonation module to disrupt the perforating command given manually from surface, if the pre-set conditions are not met. Thus the system functions as an automated pre-determined/set logic that will consider wellbore conditions as well as formation parameters. that will provide real-time engineering controls and prevent detonation of perforating guns or shaped charges unless pre-set safe operating conditions are met. A ballistic interrupt built into downhole detonation module switch board will be in place until sensors indicate that conditions are safe for firing perforation guns or shaped charges. Another important application is that the downhole detonation module feature will provide additional safety when the guns and wireline are being assembled/armed at surface. Once the downhole detonation module is active, the guns will not erroneously fire, thus providing safety to personnel and nearby assets. This approach helps to eliminate the human factor when loading and arming guns.

This approach adapts perforation-on-wireline technologies for under-balanced wellbore conditions by reducing the uncertainty associated with unknown wellbore conditions (e.g., pressure regime and fluid composition at the location of perforation). An advantage of the downhole feature is that any human interference is eliminated, thus reducing the chances of such incidents. Furthermore, the downhole detonation module is differentiated from the manual control based on a surface read-out by providing a downhole fail-safe feature for scenarios when live/misfired/unfired guns are being pulled out of hole due to any unforeseen reason including loss of communication to surface. Even if communication was still active, the downhole logic management module which is battery operated and will disrupt any inadvertent command transfer to the guns.

The bottomhole or perforating depth pressure differential can occur in scenarios including (1) unknown reservoir pressure and (2) unknown wellbore conditions (i.e., imbalanced pressure conditions). For example, the imbalanced pressure conditions can occur when hydrostatic pressure alone is not enough to create near-balance pressure condition at the time of firing guns (e.g., fluid density is not as required) or an unknown column of gas in the wellbore creates wellhead pressure incorrectly gives the impression of near-balanced condition. These uncertain conditions may lead to severe gun movement possibly causing wire kinking, wrapping of the wire across the neck of the gun, wire breaking and other consequences which add operational complexity along with significant increases operational time and costs.

The approach described in this specification can provide one or more of the following advantages.

The installation of the downhole detonation module in a perforating bottom hole assembly (BHA) can help preventing the tools/BHAs getting left in hole due to unsolicited activities downhole. In turn, this will help improve workforce safety while improving operational efficiency as no human decision is involved for firing initiation downhole. This reduces the likelihood that costly and operationally inefficient fishing operations will be required to recover a lost-in-hole BHA.

Another important application is that the downhole detonation module feature will provide additional safety at surface when the guns and wireline are being assembled. Once the downhole detonation module is active, the guns would not erroneously fire, thus providing safety to personnel and nearby assets.

The details of one or more embodiments of this approach are set forth in the accompanying drawings and the description below. Other features, objects, and advantages of this approach will be apparent from the description and drawings, and from the claims.

DESCRIPTION OF DRAWINGS

Like reference symbols in the various drawings indicate like elements.

DETAILED DESCRIPTION

This specification describes systems and methods for safely perforating oil and gas wells in under-balanced wellbore conditions using wireline perforation tools (e.g., perforation guns or shaped charges). Non-explosive perforations (abrasion and water jetting) are performed using coiled tubing or jointed pipes. During such operations, the risk of gun jumps does not exist due to BHA deployment on heavy duty, high strength and high pressure coil tubing pipe or jointed pipe. To clarify, the gun jumps happen due to the shock wave that is generated at the very moment the explosives are fired. This approach includes deploying a downhole detonation module to disrupt the perforating command given manually from surface, if the pre-set conditions are not met. Thus the system functions as an automated pre-determined/set logic that will consider wellbore conditions as well as formation parameters. that will provide real-time engineering controls and prevent detonation of perforating guns or shaped charges unless pre-set safe operating conditions are met. A ballistic interrupt built into downhole detonation module switch board will be in place until sensors indicate that conditions are safe for firing perforation guns or shaped charges. Another important application is that the downhole detonation module feature will provide additional safety when the guns and wireline are being assembled/armed at surface. Once the downhole detonation module is active, the guns will not erroneously fire, thus providing safety to personnel and nearby assets. This approach helps to eliminate the human factor when loading and arming guns.

This approach adapts perforation-on-wireline technologies for under-balanced wellbore conditions by reducing the uncertainty associated with unknown wellbore conditions (e.g., pressure regime and fluid composition at the location of perforation). These uncertain conditions may lead to severe gun movement possibly causing wire kinking, wrapping of the wire across the neck of the gun, wire breaking and other consequences which add operational complexity along with significant increases operational time and costs.

Figure 1:
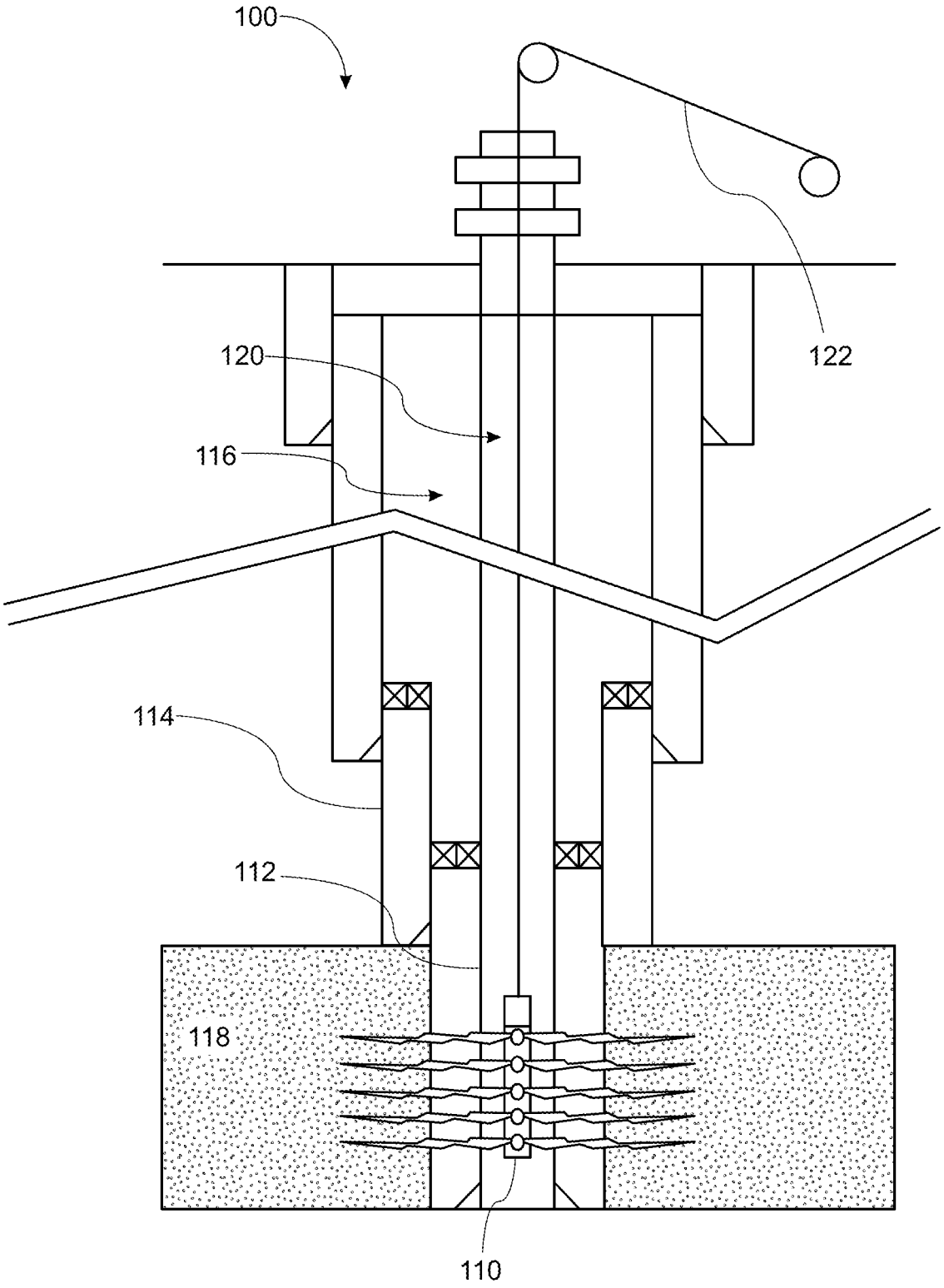
FIG. 1 is a schematic illustrating operation of a perforation BHA.

FIG. 1 is a schematic illustrating a wireline operation 100 using a perforation BHA 110 to perforate a production liner 112 and a casing 114 of the wellbore 116. The wellbore 116 has been drilled to a pay zone 118 and is open at the bottom. Formation fluids 120 have flowed into an substantially filled the production liner 112. A wireline assembly 122 has been used to lower the perforation BHA 110 to the depth of the pay zone 118 before the perforation BHA 110 is fired to pierce the production liner 112 and the casing 114 with its associated cement. The perforation BHA 110 is illustrated as including perforation guns. However, as previously mentioned, some perforation BHAs are implemented using shaped charges or other technologies to form the perforations.

In a best case, the pressure profile inside the production liner 112 is hydrostatic and pressure at the pay zone 118 can be estimated based on the depth of the pay zone 118 and the composition of the formation fluids 120 inside the production liner 112. Typically, perforation BHAs 110 are detonated once they reach at the desired depth without any confirmation of the well pressure. However, it is not safe to assume that hydrostatic conditions exist inside the production liner 112. For example, the formation fluids 120 may not fill the production liner 112 to the surface or gases may be present in the formation fluids 112. In these conditions, activating the perforation BHAs 110 can lead to severe gun movement possibly causing wire kinking, wrapping of the wire across the neck of the gun, or wire breaking.

Perforating on wireline in severe under-balanced wellbore conditions has been a persistent challenge for oil and gas wells due to the uncertainty associated with unknown wellbore conditions, i.e. the pressure regime and fluid composition at the instance of perforation. The uncertain conditions may lead to severe gun movement (specifically upward) due to explosive shock, that may further lead to BHA jump, wrapping of the wire across the neck of the gun, wire breaking, stuck BHAs and loosing of complete BHAs in the wellbore. The consequences include added operational complexities along with significant redundant operational time and remedial cost implications such as workover.

The perforation BHA 110 reduces the likelihood of such problems by checking that the well pressure matches a preset pressure after the perforation BHA 110 reaches the desired perforation depth. If the differential between the two is found to be significantly beyond the stipulated operating conditions, the perforation BHA 110 automatically disrupts the electrical signals/commands that are being relayed from surface.

Although illustrated with a BHA being deployed in a vertical wellbore using a wireline, this approach can be used in other situations. For example, coiled tubing can be can be used to deploy the perforation BHA 110 in a deviated or horizontal wellbore. It is applicable in all vertical and horizontal wireline perforating applications.

Figure 2:
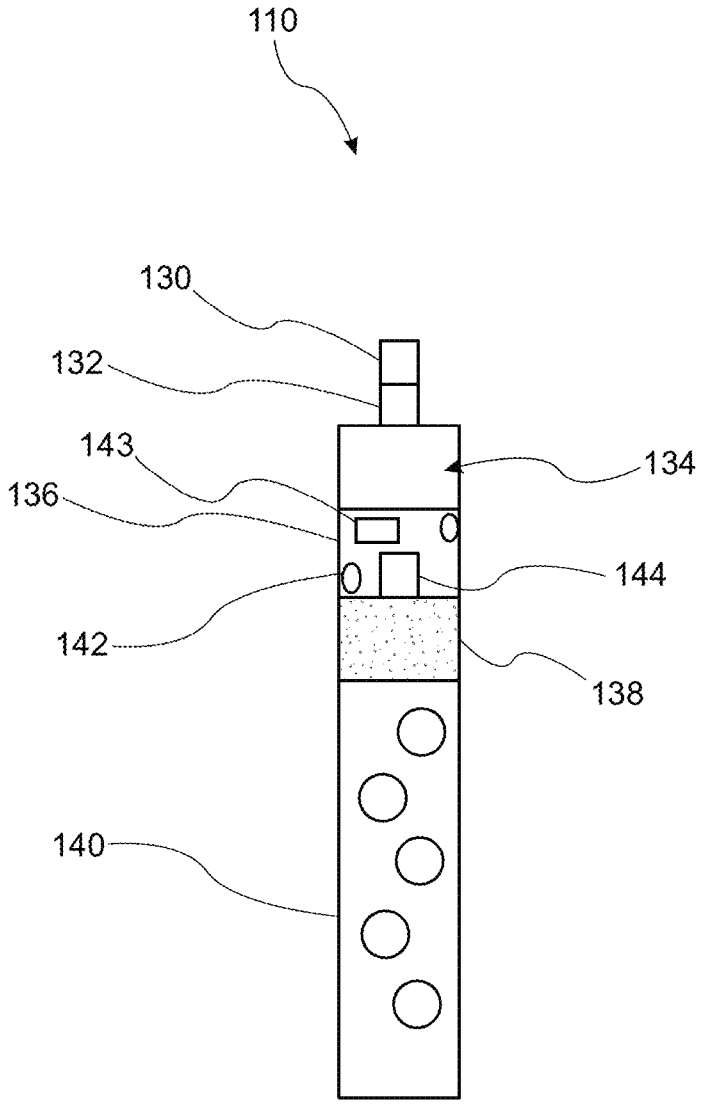
FIG. 2 is a schematic of a perforation BHA.

FIG. 2 shows the perforation BHA 110 in more detail. The perforation BHA 110 includes a cable head 130, a swivel 132, a casing collar locator (CCL) 134, a downhole detonation module 136, a firing head 138, and a perforating gun 140.

The cable head 130 and the swivel 132 are used to attach the perforation BHA 110 to a wireline. Other components are used in non-wireline applications. As non explosive The CCL 134 is a magnetic device sensitive to changes of metal thickness at casing or tubing collar that can be run in steel-cased boreholes to detect the position of casing collars. Although mainly used for depth control and depth correlation, some CCLs include shock absorber functionality. In particular, a shock absorber CCL will reduce the shock/force imparted on the CCL during perforating operations. Similarly a shooting Gamma Ray (GR) tool can also be used for depth correlations. The shock absorbers, reduce impact on the tools and thus reducing chances of damage of the CCL or the GR.

The firing head 138 and the perforating gun 140 are the primary operational parts of the perforation BHA 110. The firing head 138 contains the primary explosive required to detonate the perforating gun 140. On receipt of a trigger signal from the surface (e.g., via the wireline), the firing head 138 is activated and explodes. The firing head contains a detonator which initiates the detonation process transmitted via the primacord which runs through the gun assembly. The charges in the gun goes off with a very high energy to penetrate through the casing and into the formation. This event takes place in a very short duration and creates huge pressure/shock waves. If this pressure/shock is not accommodated by the right well conditions, failure/accident is unavoidable. The implications of which could be severe gun movement (specifically upward) due to explosive shock, that may further lead to BHA jump, wrapping of the wire across the neck of the gun, wire breaking, stuck BHAs and lose of complete BHAs in the wellbore.

The downhole detonation module 136 is installed between the firing head 138 and the uphole end of the perforation BHA 110. The term "uphole end" is used to indicate the end of the perforation BHA 110 that is uphole when the perforation BHA 110 is deployed in a wellbore.

The downhole detonation module 136 includes pressure sensors 142, a transceiver 143 with transmitter and a receiver, and a processor 144. The processor 144 is in electronic communication with the wireline 122, the pressure sensors 142, and the firing head 138. On receipt of a firing signal, the processor 144 assess local conditions based on signals from the pressure sensors 142 and, if appropriate conditions are present, relays the firing signal to the firing head 138.

The downhole detonation module 136 is programmed prior to running in hole or while the perforating BHA 110 is being run in hole. The programming of the downhole detonation module is based on a logical equation wherein the measured BH pressure is compared to the known or estimated reservoir pressure at the target depth. If the differential between the two is found to be significantly beyond the stipulated operating conditions, the downhole detonation module will automatically disrupt the electrical signals/commands that are being relayed from surface. This will limit deliberate or accidental attempts to detonate the guns under unsafe conditions and will thwart instantaneous uncontrolled gun shock propagation, minimizing gun jump and lowering the likelihood of perforating assemblies getting stuck in the wellbore.

A workflow has been developed incorporating the perforating BHA 110 with the downhole detonation module 136 to increase the reliability in down hole operations that is one of the key factors in successful field operations. This workflow is particularly useful when attempting to recover the hydrocarbons from complex reservoir and formation structures. In this scenario, a single well may be perforated in multiple zones with significant pressure differentials between the zones. The downhole detonation module 136 can be used to handle downhole uncertainties when firing a perforation guns or setting an isolation plug. In particular, this approach can avoid or reduce the chances of a gun jumping when fired due to a huge differential pressure between reservoir pressure and wellbore pressure.

Figure 3:
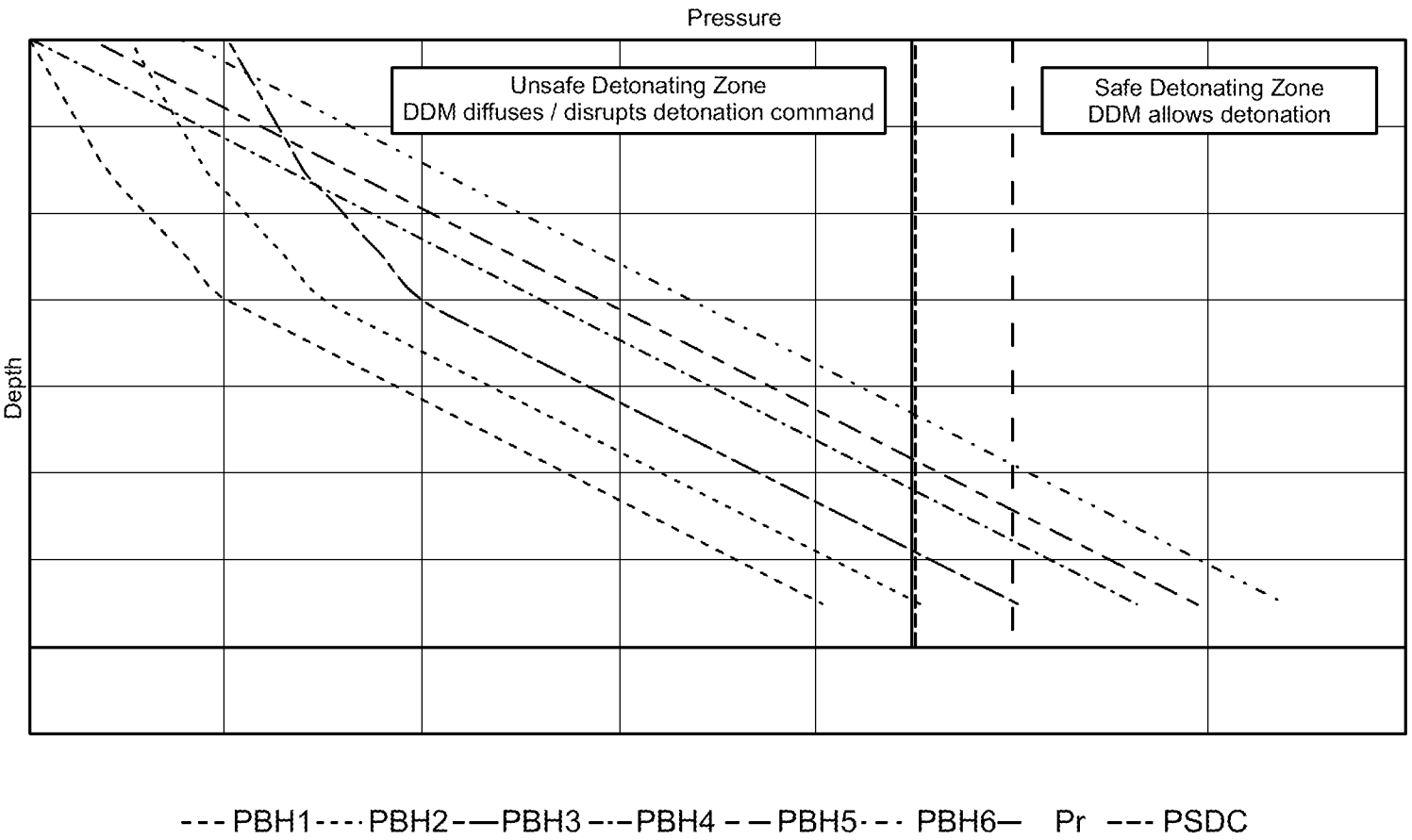
FIG. 3 is a chart illustrating bottomhole (BH) pressure regime scenarios.

FIG. 3 is a chart illustrating some BH pressure regime scenarios that can be present in wells. Pressure and depth are represented on X and Y axis respectively. The solid straight vertical line on the right side of the plot represents the reservoir pressure (PR) while the dotted vertical straight line represents the safe detonation condition for downhole detonation module activation. If a measured bottomhole pressure at current BHA depth ($P_{BH}$) is below the safe detonation pressure ($P_{SDC}$), performing perforation operations could result in operational risks and complexities. $P_{SDC}$ is the reservoir pressure (PR)—the maximum allowable pre-defined under-balance pressure for safe perforating conditions ($P_{downhole\ detonation\ module}$). Under these conditions, the downhole detonation module will interrupt the detonation command using a logical switch. In order to meet the safe conditions, remedial measures can be taken. For example, the wellbore can be pressurized to increase the $P_{BH}$, thus reducing the pressure differential on the guns at the moment of perforation. Another available option is to displace the wellbore to heavier density fluids that would in turn also increase the $P_{BH}$. Such measures will effectively lead to meeting of the set criteria of downhole detonation module activation.

Figure 4:
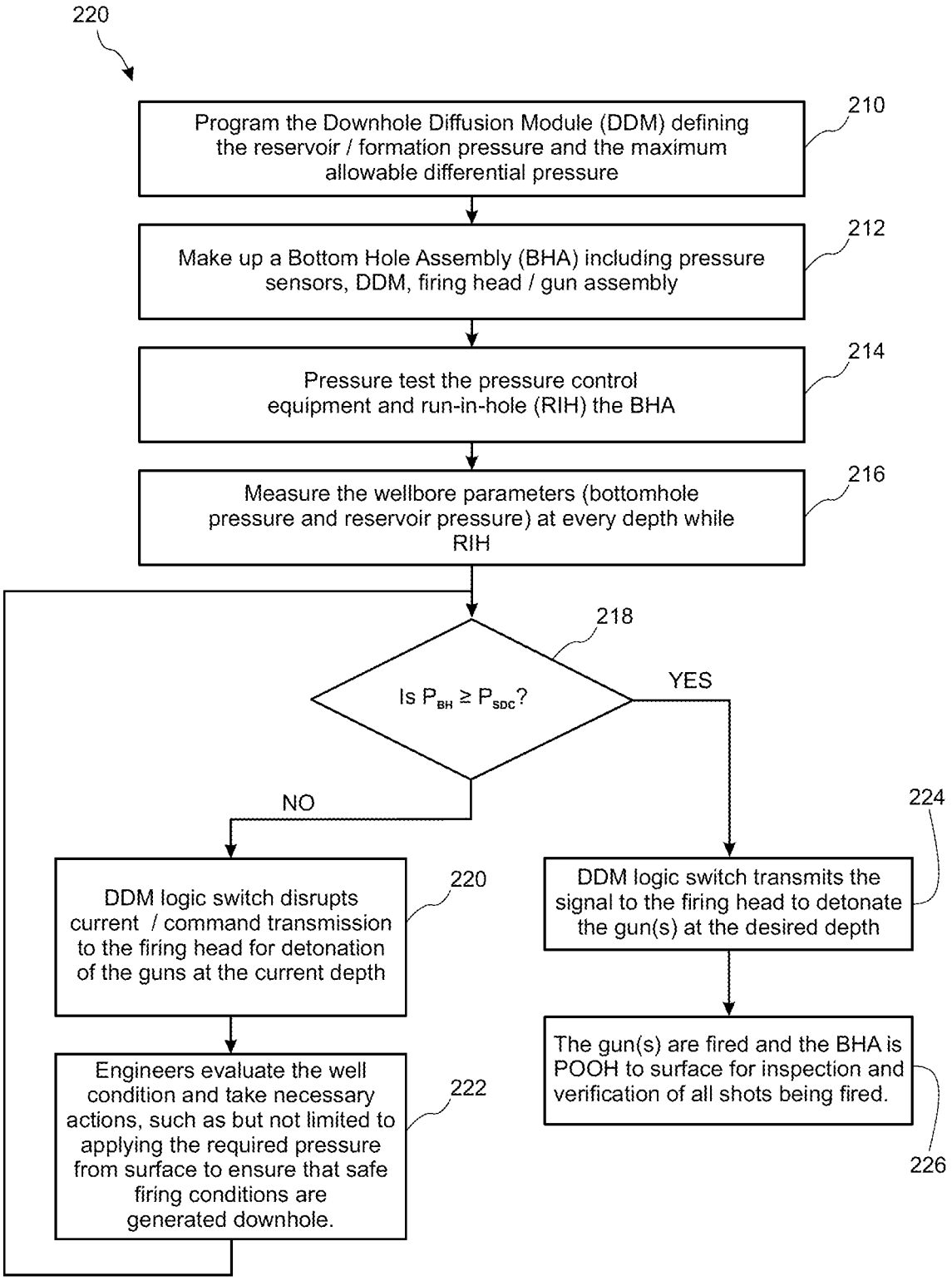
FIG. 4 is a flowchart of a method of operating a perforation BHA.

FIG. 4 is a flowchart of a method 200 of operating a perforation BHA with a downhole detonation module. The downhole detonation module is programmed to define the reservoir/formation pressure and the maximum allowable differential pressure (step 210). A BHA is made up including pressure sensors, the downhole detonation module, a firing head, and gun assembly (step 212). The BHA will typically also include other components (e.g., a logging head, weight bars, other sensors, and shock absorbers). The pressure control equipment is pressure tested before the BHA is run-in-hole (RIH) (step 214). As the BHA is RIH, wellbore parameters including at least bottomhole pressure and reservoir pressure are measured (step 216). The downhole detonation module checks if the measured bottomhole pressure at current BHA depth ($P_{BH}$) is greater than the safe detonation pressure ($P_{SDC}$) (step 218).

If the measured bottomhole pressure at current BHA depth ($P_{BH}$) is not greater than the safe detonation pressure ($P_{SDC}$), the downhole detonation module logic switch disrupts current/command transmission to the firing head for detonation of the guns at the current depth (step 220). When this occurs at a planned perforation depth, engineers evaluate the well condition and take necessary actions, such as but not limited to applying the required pressure from surface to ensure that safe firing conditions are generated downhole (step 222).

If the measured bottomhole pressure at current BHA depth ($P_{BH}$) is greater than the safe detonation pressure ($P_{SDC}$) and a firing command is transmitted from the surface, the downhole detonation module logic switch transmits the signal to the firing head to detonate the gun(s) at the desired depth (step 224). After firing, the BHA is POOH to surface for inspection and verification of all shots being fired (step 226).

This workflow avoids the assumption a full hydrostatic column that is often incorrect when in heterogenous multi-pressured layers are completed in a single well. Perforating operations in a plug and perf environment carried out with an assumption that the full hydrostatic column using under-balanced (UB) or over-balanced (OB) analysis to calculate the amount of pressure (x) to be applied or released from the tubing head pressure to create the safe near-balanced condition just prior to perforating or setting plugs. In contrast, this workflow uses the downhole detonation module 136 to detonate the guns only when pre-set requirements are met.

Perforating condition is very much dependent on the well reservoir pressure and hydrostatic pressure. Using the well hydrostatic pressure as a down hole preset condition can reduce the likelihood of perforating in extreme conditions when the reservoir has tendency to absorb fluids or well is not filled up as desired.

When the pre set down hole downhole detonation module conditions are not met, the downhole detonation module would not transmit the required signals and current for the guns to fire. The deactivation by the downhole detonation module would happen even if the surface pressure conditions are as per the calculated OB and UB condition. This illusion of near-balanced condition can occur when there is a gas present in the well bore and the hydrostatic column is different than anticipated at the target perforation depth. The similar principal applies for the plug setting in the similar environments.

Figure 5:
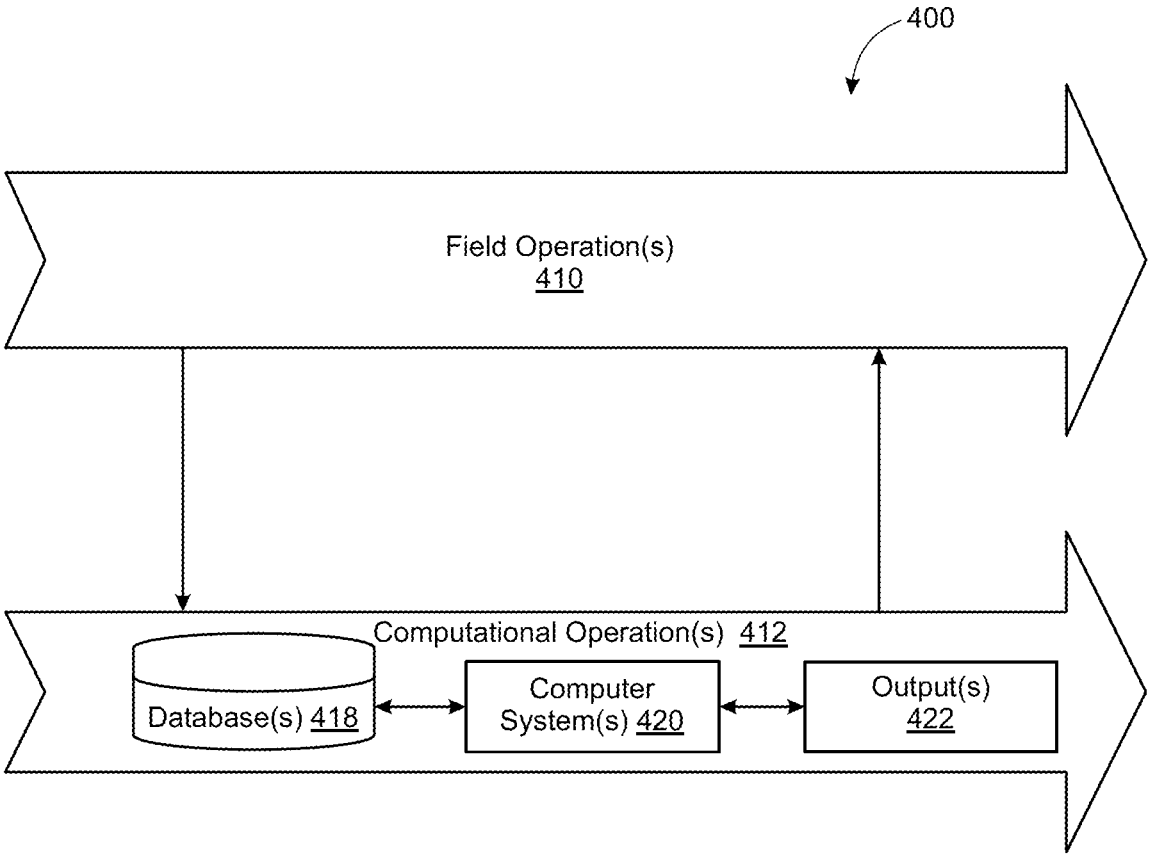
FIG. 5 illustrates hydrocarbon production operations that include both one or more field operations and one or more computational operations, which exchange information and control exploration for the production of hydrocarbons.

FIG. 5 illustrates hydrocarbon production operations 400 that include both one or more field operations 410 and one or more computational operations 412, which exchange information and control exploration for the production of hydrocarbons. In some implementations, outputs of techniques of the present disclosure can be performed before, during, or in combination with the hydrocarbon production operations 400, specifically, for example, either as field operations 410 or computational operations 412, or both.

Examples of field operations 410 include forming/drilling a wellbore, hydraulic fracturing, producing through the wellbore, injecting fluids (such as water) through the wellbore, to name a few. In some implementations, methods of the present disclosure can trigger or control the field operations 410. For example, the methods of the present disclosure can generate data from hardware/software including sensors and physical data gathering equipment (e.g., seismic sensors, well logging tools, flow meters, and temperature and pressure sensors). The methods of the present disclosure can include transmitting the data from the hardware/software to the field operations 410 and responsively triggering the field operations 410 including, for example, generating plans and signals that provide feedback to and control physical components of the field operations 410. Alternatively or in addition, the field operations 410 can trigger the methods of the present disclosure. For example, implementing physical components (including, for example, hardware, such as sensors) deployed in the field operations 410 can generate plans and signals that can be provided as input or feedback (or both) to the methods of the present disclosure.

Examples of computational operations 412 include one or more computer systems 420 that include one or more processors and computer-readable media (e.g., non-transitory computer-readable media) operatively coupled to the one or more processors to execute computer operations to perform the methods of the present disclosure. The computational operations 412 can be implemented using one or more databases 418, which store data received from the field operations 410 and/or generated internally within the computational operations 412 (e.g., by implementing the methods of the present disclosure) or both. For example, the one or more computer systems 420 process inputs from the field operations 410 to assess conditions in the physical world, the outputs of which are stored in the databases 418. For example, seismic sensors of the field operations 410 can be used to perform a seismic survey to map subterranean features, such as facies and faults. In performing a seismic survey, seismic sources (e.g., seismic vibrators or explosions) generate seismic waves that propagate in the earth and seismic receivers (e.g., geophones) measure reflections generated as the seismic waves interact with boundaries between layers of a subsurface formation. The source and received signals are provided to the computational operations 412 where they are stored in the databases 418 and analyzed by the one or more computer systems 420.

In some implementations, one or more outputs 422 generated by the one or more computer systems 420 can be provided as feedback/input to the field operations 410 (either as direct input or stored in the databases 418). The field operations 410 can use the feedback/input to control physical components used to perform the field operations 410 in the real world.

For example, the computational operations 412 can process the seismic data to generate three-dimensional (3D) maps of the subsurface formation. The computational operations 412 can use these 3D maps to provide plans for locating and drilling exploratory wells. In some operations, the exploratory wells are drilled using logging-while-drilling (LWD) techniques which incorporate logging tools into the drill string. LWD techniques can enable the computational operations 412 to process new information about the formation and control the drilling to adjust to the observed conditions in real-time.

The one or more computer systems 420 can update the 3D maps of the subsurface formation as information from one exploration well is received and the computational operations 412 can adjust the location of the next exploration well based on the updated 3D maps. Similarly, the data received from production operations can be used by the computational operations 412 to control components of the production operations. For example, production well and pipeline data can be analyzed to predict slugging in pipelines leading to a refinery and the computational operations 412 can control machine operated valves upstream of the refinery to reduce the likelihood of plant disruptions that run the risk of taking the plant offline.

In some implementations of the computational operations 412, customized user interfaces can present intermediate or final results of the above-described processes to a user. Information can be presented in one or more textual, tabular, or graphical formats, such as through a dashboard. The information can be presented at one or more on-site locations (such as at an oil well or other facility), on the Internet (such as on a webpage), on a mobile application (or app), or at a central processing facility.

The presented information can include feedback, such as changes in parameters or processing inputs, that the user can select to improve a production environment, such as in the exploration, production, and/or testing of petrochemical processes or facilities. For example, the feedback can include parameters that, when selected by the user, can cause a change to, or an improvement in, drilling parameters (including drill bit speed and direction) or overall production of a gas or oil well. The feedback, when implemented by the user, can improve the speed and accuracy of calculations, streamline processes, improve models, and solve problems related to efficiency, performance, safety, reliability, costs, downtime, and the need for human interaction.

In some implementations, the feedback can be implemented in real-time, such as to provide an immediate or near-immediate change in operations or in a model. The term real-time (or similar terms as understood by one of ordinary skill in the art) means that an action and a response are temporally proximate such that an individual perceives the action and the response occurring substantially simultaneously. For example, the time difference for a response to display (or for an initiation of a display) of data following the individual's action to access the data can be less than 1 millisecond (ms), less than 1 second(s), or less than 5 s. While the requested data need not be displayed (or initiated for display) instantaneously, it is displayed (or initiated for display) without any intentional delay, taking into account processing limitations of a described computing system and time required to, for example, gather, accurately measure, analyze, process, store, or transmit the data.

Events can include readings or measurements captured by downhole equipment such as sensors, pumps, bottom hole assemblies, or other equipment. The readings or measurements can be analyzed at the surface, such as by using applications that can include modeling applications and machine learning. The analysis can be used to generate changes to settings of downhole equipment, such as drilling equipment. In some implementations, values of parameters or other variables that are determined can be used automatically (such as through using rules) to implement changes in oil or gas well exploration, production/drilling, or testing. For example, outputs of the present disclosure can be used as inputs to other equipment and/or systems at a facility. This can be especially useful for systems or various pieces of equipment that are located several meters or several miles apart, or are located in different countries or other jurisdictions.

EXAMPLES

In some implementations, systems for perforating wellbores include: a perforating tool; and a control module including: at least one pressure sensor a processor electronically connected to the at least one pressure sensor; and a transmitter operable to send a signal to the perforating tool.

In response to an activation signal, the processor is operable to compare a signal from the least one pressure sensor with a preset pressure and, in response to determining that the signal from the least one pressure sensor is within a preset pressure range, transmitting the activation signal to the firing head.

In an example implementation combinable with any other example implementation, the processor is operable to disrupt the activation signal if the signal from the least one pressure sensor is less than a safe detonating pressure. In some cases, the safe detonating pressure is reservoir pressure minus a maximum underbalance pressure. In some cases, the control module comprises a receiver configured to be connected to a wireline. In some cases, the receiver and the transmitter are components of a transceiver. In some cases, the perforating tool comprises a firing head and perforating gun. In some cases, systems also include a cable head and swivel configured to be attached to a wireline. In some cases, systems also a casing collar locator.

In an example implementation combinable with any other example implementation, the control module is positioned between the firing head and an uphole end of the bottom hole assembly.

In an example implementation combinable with any other example implementation, the control module comprises a receiver configured to be connected to a wireline.

In an example implementation combinable with any other example implementation, the perforating tool comprises a firing head and perforating gun.

In some implementations, methods for perforating a wellbore include: defining a maximum allowable underbalance pressure; calculating a safe detonation pressure for the wellbore based on reservoir pressure and the maximum allowable underbalance pressure; running a bottom-hole assembly down the wellbore on a wireline, wherein the bottom hole assembly comprises a downhole detonation control module; receiving an activation signal at the downhole detonation control module; and in response to determining that bottom-hole pressure at the bottom-hole assembly is not less than the safe detonation pressure, transmitting the activation signal from the downhole detonation control module to a firing head of a gun assembly.

In an example implementation combinable with any other example implementation, methods also include perforating the wellbore in multiple zones with different reservoir pressures. In some cases, methods also include taking remedial action in response to determining that bottom-hole pressure at the bottom-hole assembly is less than the safe detonation pressure. In some cases, the remedial action comprises pressurizing the wellbore. and/or displacing fluids in the wellbore with denser fluids.

In an example implementation combinable with any other example implementation, methods also include firing the gun assembly in response to the activation signal. In some cases, methods also include retrieving the bottom-hole assembly from the wellbore. In some cases, the wellbore is perforated in a first zone. In some cases, methods also include firing the gun assembly in response to the activation signal to perforate the wellbore in a second zone with a different reservoir pressure than the first zone.

A number of embodiments of the systems and methods have been described. Nevertheless, it will be understood that various modifications may be made without departing from the spirit and scope of this specification. Accordingly, other embodiments are within the scope of the following claims.

What is claimed is:

1. A bottom hole assembly for perforating wellbores, the bottom hole assembly comprising:

a perforating tool;

a control module comprising:

at least one pressure sensor a processor electronically connected to the at least one pressure sensor; and a transmitter operable to send a signal to the perforating tool;

wherein in response to an activation signal, the processor is operable to compare a signal from the least one pressure sensor with a preset pressure and, in response to determining that the signal from the least one pressure sensor is within a preset pressure range, transmitting the activation signal to a firing head;

wherein the processor is operable to disrupt the activation signal if the signal from the least one pressure sensor is less than a safe detonating pressure; and wherein the safe detonating pressure is reservoir pressure minus a maximum underbalance pressure.

2. The bottom hole assembly of claim 1, wherein the control module comprises a receiver configured to be connected to a wireline.

3. The bottom hole assembly of claim 2, wherein the receiver and the transmitter are components of a transceiver.

4. The bottom hole assembly of claim 3, wherein the perforating tool comprises a firing head and perforating gun.

5. The bottom hole assembly of claim 4, further comprising a cable head and swivel configured to be attached to a wireline.

6. The bottom hole assembly of claim 5, further comprising a casing collar locator.

7. The bottom hole assembly of claim 6, wherein the control module is positioned between the firing head and an uphole end of the bottom hole assembly.

8. The bottom hole assembly of claim 1, wherein the control module comprises a receiver configured to be connected to a wireline.

9. The bottom hole assembly of claim 1, wherein the perforating tool comprises a firing head and perforating gun.

* * * * *